US009869976B2

(12) United States Patent
Perko et al.

(10) Patent No.: US 9,869,976 B2
(45) Date of Patent: Jan. 16, 2018

(54) WATCH CASE AND WRIST WATCH DEVICE

(71) Applicants: Panu Perko, Espoo (FI); Jukka Manni, Helsinki (FI)

(72) Inventors: Panu Perko, Espoo (FI); Jukka Manni, Helsinki (FI)

(73) Assignee: Suunto Oy, Vantaa (FI)

( * ) Notice: Subject to any disclaimer, the term of this patent is extended or adjusted under 35 U.S.C. 154(b) by 113 days.

(21) Appl. No.: 13/644,339

(22) Filed: Oct. 4, 2012

(65) Prior Publication Data

US 2013/0088942 A1 Apr. 11, 2013

(30) Foreign Application Priority Data

Oct. 5, 2011 (EM) ..... 11 008080.1

(51) Int. Cl.

| | |
|---|---|
| ***G04B 37/00*** | (2006.01) |
| ***G04B 37/14*** | (2006.01) |
| ***G04G 17/08*** | (2006.01) |
| ***G04R 60/10*** | (2013.01) |
| ***G04G 21/04*** | (2013.01) |

(52) U.S. Cl.

CPC ..... *G04G 17/08* (2013.01); *G04B 37/0058* (2013.01); *G04B 37/1486* (2013.01); *G04G 21/04* (2013.01); *G04R 60/10* (2013.01)

(58) Field of Classification Search

CPC .... G04B 37/00; G04B 37/12; G04B 45/0069; G04B 37/0058; G04B 37/1486; G04G 17/08; G04G 21/04; G04R 60/10

USPC ..... 368/88, 278, 281–283, 291; 224/164, 224/174, 180; 24/265 B, 265 WS

See application file for complete search history.

(56) References Cited

U.S. PATENT DOCUMENTS 4,419,770 A * 12/1983 Yagi et al. ..... 455/301
4,444,520 A * 4/1984 Hanakata ..... B41J 2/32 224/267
4,935,910 A * 6/1990 Akasaka ..... G04B 37/1486 224/164
5,224,076 A * 6/1993 Thorp ..... 368/10
5,233,574 A * 8/1993 Walder et al. ..... 368/276
5,235,561 A * 8/1993 Seager ..... G04B 47/00 368/10
5,243,578 A * 9/1993 Mathez ..... 368/88
5,499,398 A * 3/1996 Kudoh ..... H01Q 1/273 343/702
D395,403 S * 6/1998 Hysek ..... D10/30
5,781,511 A * 7/1998 Yasukawa ..... A61B 5/02438 368/10
6,200,018 B1 * 3/2001 Dubugnon ..... G04G 17/083 224/168

(Continued)

*Primary Examiner* — Vit W Miska
(74) *Attorney, Agent, or Firm* — Terence P. O'Brien

(57) ABSTRACT

The present invention is related to a watch case adapted to be integrated into a wrist watch device, the watch case comprising an inner volume for housing internal components of the wrist watch device and attachment elements for attaching at least one watch strap of the wrist watch device, wherein at least one portion of the inner volume of the watch case extends laterally (or longitudinally) beyond the points of attachment of the at least one watch strap. The present invention is also directed to a corresponding watch strap as well as to a wrist watch device comprising such a watch case.

18 Claims, 3 Drawing Sheets

(56) References Cited

U.S. PATENT DOCUMENTS 6,233,203 B1 * 5/2001 Kawata ..... G04C 10/00 368/10
6,529,754 B2 * 3/2003 Kondo ..... A61B 5/02438 600/335
6,619,835 B2 * 9/2003 Kita ..... A44C 5/0015 368/10
6,726,070 B2 * 4/2004 Lautner ..... A44C 5/0007 224/221
6,796,708 B2 * 9/2004 Kawamata ..... G04B 37/1486 368/276
6,813,223 B1 * 11/2004 Born ..... G04G 13/021 368/255
7,954,680 B2 * 6/2011 Ishihara et al. ..... 224/177
8,328,055 B1 * 12/2012 Snyder ..... A45F 5/00 224/197
D673,464 S * 1/2013 Perko et al. ..... D10/38
8,408,436 B2 * 4/2013 Berry ..... A63B 24/00 224/176
8,994,827 B2 * 3/2015 Mistry ..... H04N 5/2252 348/158
9,204,710 B1 * 12/2015 Burns ..... A45F 5/00
2001/0017663 A1 * 8/2001 Yamaguchi ..... H04N 1/00249 348/373
2004/0172968 A1 * 9/2004 Hug ..... A44C 5/12 63/7
2004/0218474 A1 * 11/2004 Yamazaki et al. ..... 368/82
2005/0047282 A1 * 3/2005 Sakurazawa et al. ..... 368/281
2005/0235464 A1 * 10/2005 Sima ..... 24/265 WS
2006/0133213 A1 * 6/2006 Robert et al. ..... 368/11
2007/0015980 A1 * 1/2007 Numada ..... A61B 5/489 600/322
2007/0041275 A1 * 2/2007 Barras et al. ..... 368/14
2008/0112270 A1 * 5/2008 Yeh et al. ..... 368/14
2009/0059730 A1 * 3/2009 Lyons et al. ..... 368/69
2009/0168612 A1 * 7/2009 Robin et al. ..... 368/282
2011/0003665 A1 * 1/2011 Burton et al. ..... 482/9
2011/0013490 A1 * 1/2011 Li ..... G04G 17/08 368/10
2011/0128824 A1 * 6/2011 Downey et al. ..... 368/14
2011/0205851 A1 * 8/2011 Harris ..... G04G 9/0064 368/14
2012/0051193 A1 * 3/2012 Yu ..... G04G 17/06 368/204
2012/0176871 A1 * 7/2012 Ueno ..... G04B 37/052 368/287

* cited by examiner

WATCH CASE AND WRIST WATCH DEVICE

RELATED APPLICATIONS

The present application claims priority to European Patent Application Serial No. 11 008080.1 entitled WATCH CASE AND WRIST WATCH DEVICE, and filed on Oct. 5, 2011.

FIELD OF THE INVENTION

The present invention relates generally to a watch case adapted to be integrated into a wrist watch device, the watch case comprising an inner volume for housing internal components of the wrist watch device and attachment elements for attaching at least one watch strap of the wrist watch device, as well as to a corresponding watch strap respectively a corresponding wrist watch device.

BACKGROUND OF THE INVENTION

In general, the present invention relates to wrist watches and wrist-top computers, which may be equipped with numerous functions, including for example location determination, especially by means of the global positioning system (GPS), capture and analysis of the cardiac frequency of the user of the device, altimetric—and barometric applications, and the like. These diverse functions requiring corresponding electronic components inside the watch, such wrist computers usually are quite voluminous and, in particular, often need to be equipped with watch cases of rather large size, some of these devices having in fact a width of 4 cm to 6 cm or even more. This has consequences on several aspects both on the level of the case as of the whole device. A first aspect is induced by the fact that conventional wrist watch cases are provided at opposite lateral ends with the watch straps allowing the user to secure the device on his wrist. In the mentioned case of large wrist computers this causes a large distance between the respective ends of the watch straps, i.e. between their axes of attachment to the watch case. Consequently, devices equipped with such large cases are rather uncomfortable, if not impossible, to wear by persons having a small wrist diameter. This aspect is even worse for a category of conventional wrist computers which have a case made up of a first part of appreciably circular shape which is prolonged in the direction of one of its watch straps by a second part of appreciably longitudinal shape and of similar width like the watch strap. In fact, such prolongation is often required to have sufficient space for all electronic components, including the normal watch movement, the energy source, as well as supplementary equipment like a GPS receiver and antenna, etc. With the corresponding watch strap being in such conventional devices attached to the outer end of the longitudinal watch case prolongation, the distance between the respective ends of the watch straps is thus further increased. This means that the disadvantage in view of the wearing of such devices by persons having a small wrist is even more accentuated for such kind of devices, even though the watch case prolongation is usually inclined downwards in order to better fit the shape of a human wrist.

A second aspect caused by the large size of such devices lies in the body of the watch case itself. In fact, watch cases for such devices may have quite complicated shapes, e.g. in the above mentioned case of watch cases made up of a first part of appreciably circular shape prolonged by a second, downwards bent part of appreciably longitudinal shape. Prior art watch cases of this type are made up of several parts, usually of a bottom part having approximately half of the height of the whole watch case and of at least one cover part which provides for the remaining height and is fitted onto the bottom part, these parts forming together the main body of the watch case. Such splitting of the main housing of the wrist computer into two or more parts may have some advantages from the point of view of manufacturing the parts of the watch case and of the simplicity of assembling the whole device. However, there are important disadvantages of such construction, especially due to the fact that the individual parts making up the watch case in most of the cases need to be assembled in water tight manner, given that most wrist computers are designed for applications requiring water tightness. A main housing with a split design, of course, requires a gasket of quite complicated shape, which by definition may cause future problems in view of the water tightness of the device. Also, the total surface to be sealed is increased, which not only diminishes reliability of water tightness but moreover is voluminous, thus further reducing the space available for the electronic components of the device. At the same time, wrist computers usually are exposed to all kind of situations and therefore need to be designed both in robust and easy to use manner. Watch cases with a main body made up of several parts suffer drawbacks in this respect, because of evidently being less robust, since any bonding between parts is typically a weakness in construction, as well as being less easy to use by the end user. For example, boundary interfaces between the housing parts of such conventional watch cases form edges collecting impurities which will need frequent cleaning by the user. At the same time, such boundary interfaces impose limits on the design of the device and are potentially negative for its aesthetic perception, since not allowing to have surfaces with a clean look all over the watch case. Moreover, ensuring water tightness on 3D (not flat) interconnecting surfaces is more challenging, hence costly and subject to defects.

Prior art watch cases and wrist watch devices of the type described here above thus inherently comprise several problems and disadvantages. Therefore, there is a need for a watch case, for corresponding watch straps, as well as for a wrist watch device lacking these drawbacks and difficulties.

SUMMARY OF THE INVENTION

It is thus the object of the present invention to overcome the above mentioned disadvantages. It is particularly an object to realize a watch case of rather large size allowing both integration of numerous electronic components required by the corresponding watch device and comfortable wear of the same by all persons irrespective of their wrist diameter. It is also an object to have a watch being of robust and relatively simple construction, leaving a maximum of usable space in its inside. It is also an object to have a watch assuring optimal water tightness and aesthetic appearance, as well as keeping its production cost comparatively low. Furthermore, it is the object of the present invention to realize corresponding watch straps to be used in connection with such a watch case as well as a corresponding wrist watch device incorporating such a watch case.

The present invention provides for a watch case configured for use with a wristwatch device having a plurality of internal components and first and second watch straps. The watch case has a first longitudinal dimension. The watch case includes a main body and a plurality of strap attachment elements. The main body defines an inner volume, and is configured to house the internal components. The plurality of strap attachment elements are connected to the main body. The attachment elements include a first set of strap attachment points longitudinally spaced apart from a second set of strap attachment points. The first and second sets of strap attachment points are configured for coupling to the first and second watch straps to the main body, respectively. The first and second sets of strap attachment points define first and second transverse lines, respectively. At least a portion of the inner volume of the main body longitudinally extends beyond at least one of the first and second transverse lines.

The watch case according to the present invention distinguishes from prior art by the fact that at least one portion of the inner volume of the main body of the watch case extends longitudinally beyond the points of attachment of the at least one watch strap. The inner volume defined by the main body can also extend laterally beyond two or more points of attachment of a watch strap to the main body. In a preferred embodiment, the points of attachment of the at least one watch strap are situated above the plane of the bottom of the watch case.

Due to the fact that the watch case can provide an attachment for the watch straps situated both higher in relation to the watch case and closer to each other, it is possible to provide a solution to the above mentioned technical problems, in particular to allow comfortable wear of corresponding wrist watch devices also for people having a smaller wrist circumference.

Moreover, in another preferred embodiment, the watch case comprises an inner volume for housing internal components of the wrist watch device and attachment elements for attaching at least one watch strap of the wrist watch device, at least one portion of the inner volume of the watch case extends laterally and the watch case has a body made of one single piece. Advantageously, the inner volume of the main body of the watch case for housing internal components of the wrist watch device furthermore comprises just one single opening oriented towards the opposite side of the bottom of the watch case, and the single opening is delimited by a surface lying in a plane, with the delimiting surface of the inner volume having, in an even more preferred embodiment, an appreciably circular circumference.

Due to these features, the watch case is particularly adapted to be used for wrist watch devices and wrist computers requiring water tightness, since the sealing may be realized in simple, space saving, and very safe manner by a single gasket of annular shape mounted on the circular opening having one single sealing plane. Moreover, the resulting watch case may be designed in an aesthetically attractive manner having a clean surface look and is particularly robust, since being of one piece.

This invention will become more fully understood from the following detailed description, taken in conjunction with the accompanying drawings described herein below, and wherein like reference numerals refer to like parts.

BRIEF DESCRIPTION OF THE DRAWINGS

The attached figures schematically and by way of example illustrate the principles of the present invention.

DETAILED DESCRIPTION OF THE PREFERRED EMBODIMENTS

In the following, the invention shall be described in detail with reference to the above mentioned figures.

Figure 1B:
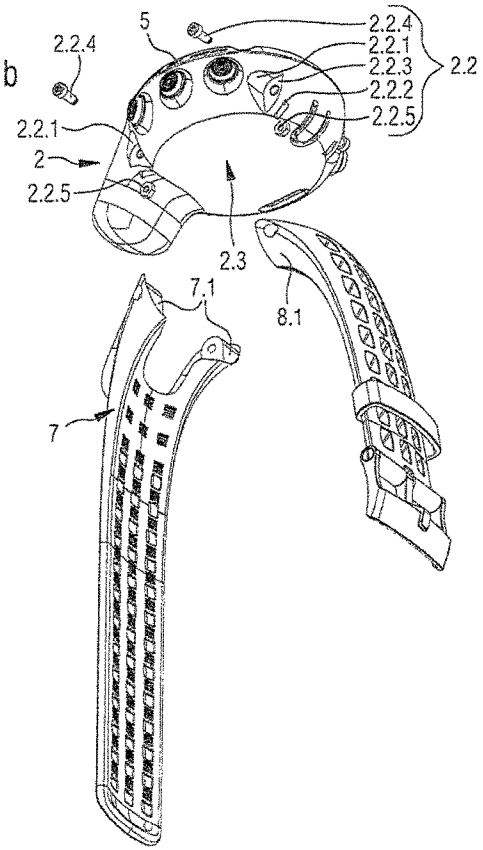
FIG. 1*b* is a perspective bottom view on the wrist watch device of FIG. 1*a* with the watch case being shown in an assembled state and the watch straps shown in a disassembled state.
Figure 1A:
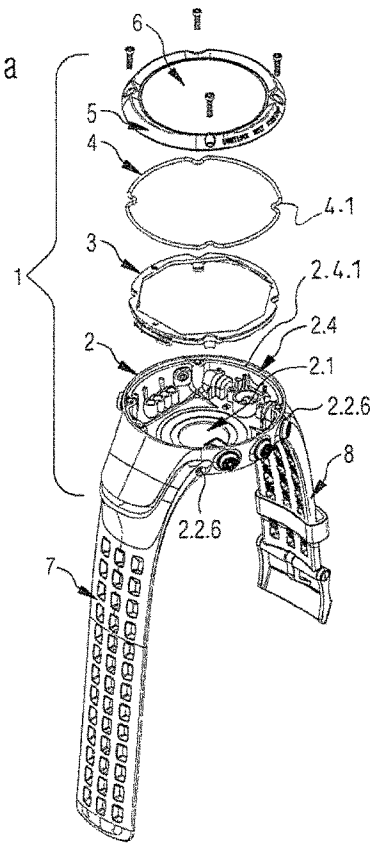
FIG. 1*a* is an exploded perspective top view of a wrist watch device including a watch case and watch straps according to the present invention.

As can be seen in convenient manner in FIG. 1*a* which shows an exploded perspective top view on a wrist watch device comprising a watch case as well as watch straps according one preferred embodiment of the present invention, a watch case 1, such as proposed by the present invention is adapted to form part of a wrist watch device, like the type of wrist computers mentioned in the introduction. In particular, the watch case 1 according to the present invention comprises a main body 2 for the watch case, an annular securing ring 3 which is situated in the assembled state of the watch case at the upper end of the main body 2 near its opening 2.4 and allows to secure the other components of the device, like e.g. the watch movement, the energy source, et cetera, inside the main body 2, a gasket 4 also situated in the assembled state of the watch case at the level of the opening 2.4 of the main body 2 in a specific gasket groove 2.4.1 and guaranteeing water tightness of the watch case 2, and an annular cover 5 with the watch glass 6. A watch crystal 6 may be fixed directly in water tight manner on the annular cover 5 or pressed by the latter against the watch case main body 2 respectively the securing ring 3, since the annular cover 5 is rigidly mounted on the main body 2 of the watch case, for example by screws such as shown in FIG. 1*a* or by other equivalent means. As shown in FIG. 1*a*, the gasket 4 has a general annular shape and may include inwardly curved portions 4.1 allowing the screw holes to be maintained out of the sealed volume. In alternative preferred embodiments, the gasket can be formed in other shapes. The gasket 4 is preferably made of plastic, for example of polyamide or of a similar material. In alternative embodiments, the gasket can be made of other materials, such as paper, wood, an elastomeric material, and a fiber composite material, and other conventional gasket materials. The sealing function of the gasket could also be performed by other techniques such as gluing, 2-sided tape, and rubber or silicon o-ring. The gasket has of course a shape adapted to the shape of the watch case and can have a general circular shape as shown in the FIG., or an oval or square shape depending on the shape of the watch case. It is also important to note that the gasket 4 is generally flat and that its median plane lies in a single plane, which facilitates and enables a cheaper sealing solution. In other preferred embodiments, the gasket can by other shapes. The gasket groove 2.4.1 can have a wedge shape. The diverse other components of a corresponding wrist watch device like the watch movement, energy source, or other parts, are not shown in the figures for reasons of clarity, since these are not essential for the present invention. One of skill in the art would understand what other components of a wrist watch may be desired for a particular application or user.

Such as can also be seen in FIG. 1*a*, the watch case main body 2 defines an inner volume 2.1 for housing the internal components of the wrist watch device. Like shown in particularly clear manner in FIG. 4*b*, the inner volume 2.1 may be perceived as having a central part 2.1.1 of appreciably circular shape prolonged laterally on at least one side, towards the direction of the zone where watch straps 7, 8 are mounted on the watch case, by a lateral part 2.1.2 of appreciably longitudinal shape. Like explained in the introduction and most perceptible in FIG. 1*b* showing a perspective bottom view on the wrist watch device with the watch case being in the assembled state, whereas the corresponding watch straps being shown in disassembled state, such prolongation of the watch case 1, 2 is useful for wrist computers in order to allow the inner volume 2.1 to be of sufficient size for housing all necessary other components of such a device, especially all types of electronic components including the normal watch movement, the energy source, as well as supplementary equipment. The latter may for example consist in devices like a GPS receiver and its antenna required for nowadays location determination systems, pressure capture devices required for altimeters and barometers, detectors of the cardiac frequency, or even radio receivers, etc. Of course, the watch case 1, respectively its main body 2 also comprises attachment elements 2.2 for attaching at least one watch strap 7, 8 of the wrist watch device, such as visible in FIGS. 1*a* and 1*b*, too. Preferably, both watch straps 7, 8 are attached by the attachment elements 2.2 respectively are of the type that will be described in more detail in a later section of this description.

Figure 2A:
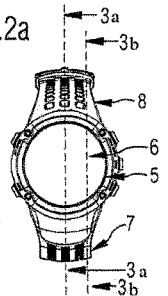
FIG. 2*a* is a schematic top view of the wrist watch device of FIG. 1*a*.
Figure 2B:
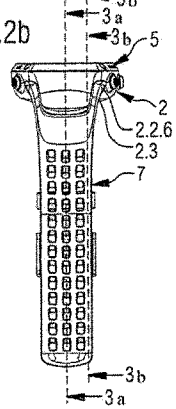
FIG. 2*b* is a side elevation of the wrist watch device illustrated of FIG. 1*a*.

To continue the description of the structure of the main body 2 of the watch case, it is to be noted that one of the distinguishing features of the watch case according to the present invention with respect to prior art consists in that at least one portion 2.1.2 of the inner volume 2.1 of the watch case 1, in particular the lateral part 2.1.2 of appreciably longitudinal shape of the inner volume 2.1 which is particularly adapted to house any supplementary electronic component of the wrist watch device like e.g. a GPS receiver and antenna, extends laterally (or longitudinally) beyond the points of attachment 2.2.6 of the at least one watch strap 7, 8. This feature is particularly well perceptible in FIGS. 3*a* and 3*b* which show sectional views of the wrist watch device along the lines 3*a*-3*a* respectively 3*b*-3*b* indicated in FIGS. 2*a* and 2*b*. The former, FIG. 2*a*, is a schematic top view of the wrist watch device according to the present invention in its assembled state, and the latter, FIG. 2*b*, shows a side elevation of the same wrist watch device, viewed from the face of the device which comprises the portion 2.1.2 of the inner volume 2.1 of the watch case extending laterally (or longitudinally) beyond the points of attachment 2.2.6 of the watch strap 7 which is mounted on this side of the wrist watch device.

The strap attachment elements 2.2 are connected to the main body 2. The attachment elements 2.2 including a first set of strap attachment points 2.2.6 longitudinally spaced apart from a second set of strap attachment points 2.2.6. The first and second sets of strap attachment points 2.2.6 are configured for coupling to the first and second watch straps 7 and 8 to the main body 2, respectively. The first and second sets of strap attachment points 2.2.6 defining first and second transverse lines, respectively. At least a portion of the inner volume of the main body 2 longitudinally extending beyond at least one of the first and second transverse lines. FIG. 3*a* schematically illustrates one preferred, but not necessarily required configuration of the watch case 1 according to the present invention which further distinguishes in that the at least one laterally extending portion 2.1.2 of the inner volume 2.1 of the watch case is situated at least partially underneath a bottom plane 2.3.1 generally defined by the bottom 2.3 of the main body 2 of the watch case, which allows to further increase the usable volume whilst following the natural shape of the human wrist. In this context, it should be noted that, in general, the at least one portion 2.1.2 of the inner volume 2.1 of the watch case extending laterally (or longitudinally) beyond the points of attachment 2.2.6 of the at least one watch strap 7, 8 may be situated only on one side of the watch case 1, next to the zone of the watch case comprising the attachment elements 2.2 for attaching one of the watch straps 7, 8, or in other preferred embodiments, on both sides of the watch case, i.e. next to both zones of the watch case comprising the attachment elements 2.2 for attaching the watch straps 7, 8. In other words, the watch case 1 according to the present invention may comprise, depending on the number of electronic components to be housed or other parameters influencing the design of the watch case, lateral (or longitudinal) prolongations on one or on both sides, with corresponding adaptation of the watch case and watch straps on each side concerned. In an alternative preferred embodiment, the inner volume of the main body can longitudinally extend beyond the first and second transverse lines defined by the first and second sets of strap attachment points 2.2.6.

Figure 3B:
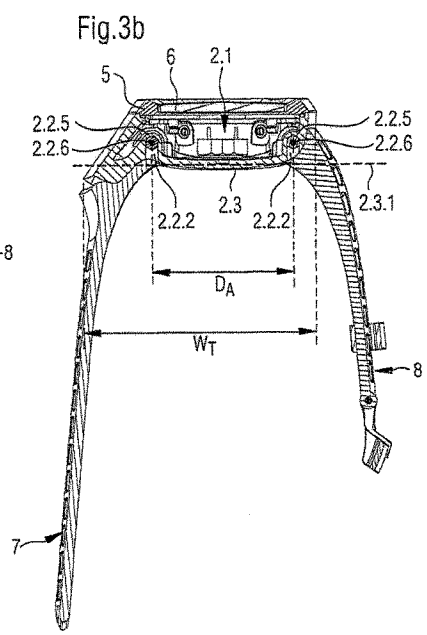
FIGS. 3*a* and 3*b* show longitudinal cross-sectional views of the wrist watch device taken along the lines 3*a*-3*a* and 3*b*-3*b*, respectively, of FIGS. 2*a* and 2*b*.
Figure 3A:
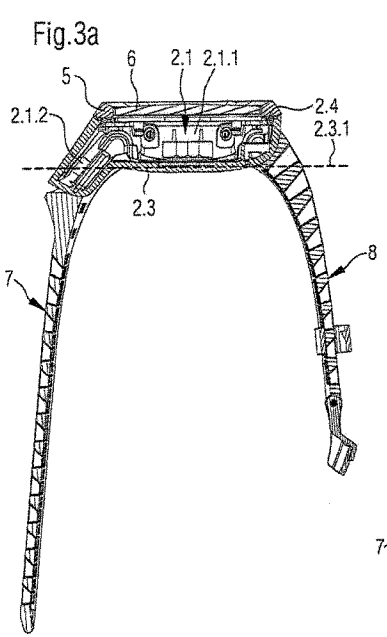

FIG. 3*b* illustrates the even more preferred embodiment comprising the additional feature, shown by the way in all figures but not necessarily required either, that the points of attachment 2.2.6 of the at least one watch strap 7, 8 are situated above the bottom plane 2.3.1 of the bottom 2.3 of the watch case, such that the virtual axes of rotation for attachment of the watch straps 7, 8 are situated especially high as compared to the height of the watch case 1. In particular, the points of attachment 2.2.6 of the at least one watch strap 7, 8, respectively the virtual axes of rotation for attachment of the watch straps 7, 8 may be situated at a height of about 30% to 60% of the total height of the main body 2 of the watch case 1. Alternatively, it would for example be possible, for reasons that will become clear in the course of the further description, to place the points of attachment 2.2.6 of the watch straps 7, 8, respectively at least one watch strap 7 or 8, at the level of the bottom 2.3 of the watch case, such that the virtual axes of rotation for attachment of the watch straps 7, 8 were placed inside the wall of the bottom 2.3 of the watch case.

The main body 2 of the watch case 1 has a total width, or maximum longitudinal dimension (a first longitudinal dimension), $W_T$. The first and second transverse lines are longitudinally spaced apart by a second longitudinal dimension $D_A$. In one preferred embodiment, the second longitudinal dimension is sized to be within the range of 50 to 90 percent of the first longitudinal dimension $W_T$. Referring to FIG. 3*b*, the distance $D_A$ between the points of attachment 2.2.6 of the first watch strap 7 and the points of attachment 2.2.6 of the second watch strap 8 of the wrist watch device, i.e the distance between the two virtual axes of rotation for attachment of the two watch straps 7 and 8 (the second longitudinal dimension $D_A$), is preferably situated in the range of 50% to 90% of the total width $W_T$ of the watch case. In a particularly preferred embodiment, the second longitudinal dimension $D_A$ is within the range of 65% to 85% of the first longitudinal dimension, total width $W_T$ of the watch case. The axes of rotation of the watch straps 7, 8 thus may be arranged such as to be particularly close to each other in view of the size of the watch case 1, 2.

Another important feature of a watch case 1 according to the present invention consists in that the attachment elements 2.2 for attaching the at least one watch strap 7, 8 of the wrist watch device to the watch case 1 are shaped and positioned such as not to traverse the at least one portion 2.1.2 of the inner volume 2.1 of the watch case extending laterally (or longitudinally) beyond the points of attachment 2.2.6 of the at least one watch strap 7, 8. This is particularly well visible in FIGS. 4*b* and 4*c* which show sectional views of the wrist watch device along the lines 4*b*-4*b* and 4*c*-4*c*, respectively, indicated in FIG. 4*a*, the latter being a side elevation of the wrist watch device viewed from one of the sides of the device comprising the command means for the wrist watch, like for example push buttons, a watch crown, or the like. Like shown in these figures, the attachment elements 2.2 do not traverse the lateral part 2.1.2 of appreciably longitudinal shape of the inner volume 2.1, which is important in order to optimally provide supplementary space for the internal components of the wrist watch device. FIG. 4*c* shows that this is the case even, and in particular, in the embodiment of the watch case 1 where the points of attachment 2.2.6, i.e. the virtual axes of rotation, of the at least one watch strap 7, 8 are situated above the plane 2.3.1 of the bottom 2.3 of the watch case.

Thus, in view of these features, the points of attachment 2.2.6 of the watch straps 7, 8 may be placed, if, of course, under certain limits, nevertheless at a rather freely selectable portion both of the height as well as of the width of the watch case 1, such as to allow a particularly comfortable wear of larger wrist watch devices also for people having a smaller wrist. In view of the above, it is clear that this is achieved by the use of non-traversing attachment elements 2.2, or alternatively, as mentioned above, by placing the points of attachment 2.2.6 of the watch straps 7, 8 such that the virtual axes of rotation for attachment of the watch straps 7, 8 are inside the wall of the bottom 2.3 of the watch case. In one preferred embodiment, the combination of the high position of the points of attachment 2.2.6 of the watch straps 7, 8 relative to the watch case and the rapprochement of the axes of rotation of the watch straps 7, 8 as compared to the total width of the watch case provides for optimal design and wear comfort in view of a watch case of given size and shape.

Figure 4B:
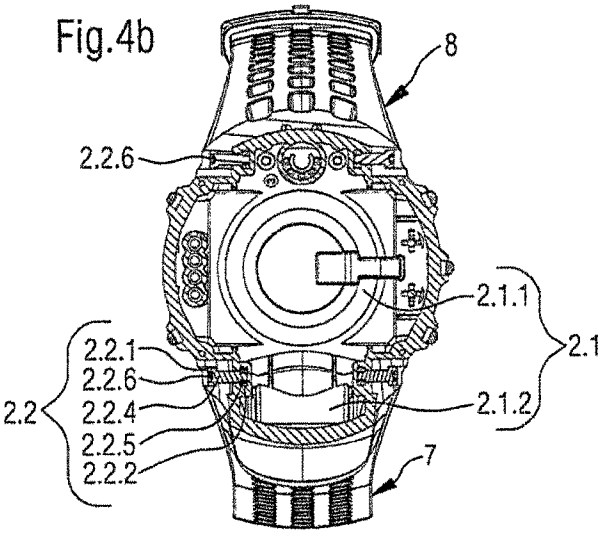
FIG. 4*b* shows a cross-sectional view of the wrist watch device taken along line 4*b*-4*b* of FIG. 4*a*.
Figure 4C:
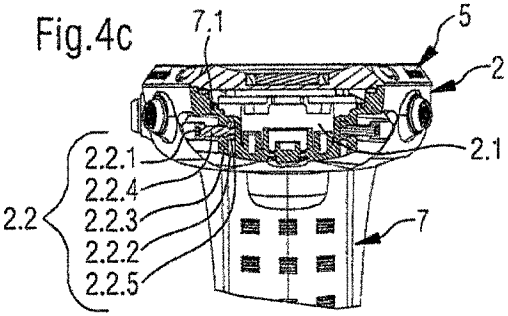
FIG. 4*c* shows a transverse cross-sectional view of the wrist watch device taken along line 4*c*-4*c* of FIG. 4*a*.
Figure 4A:
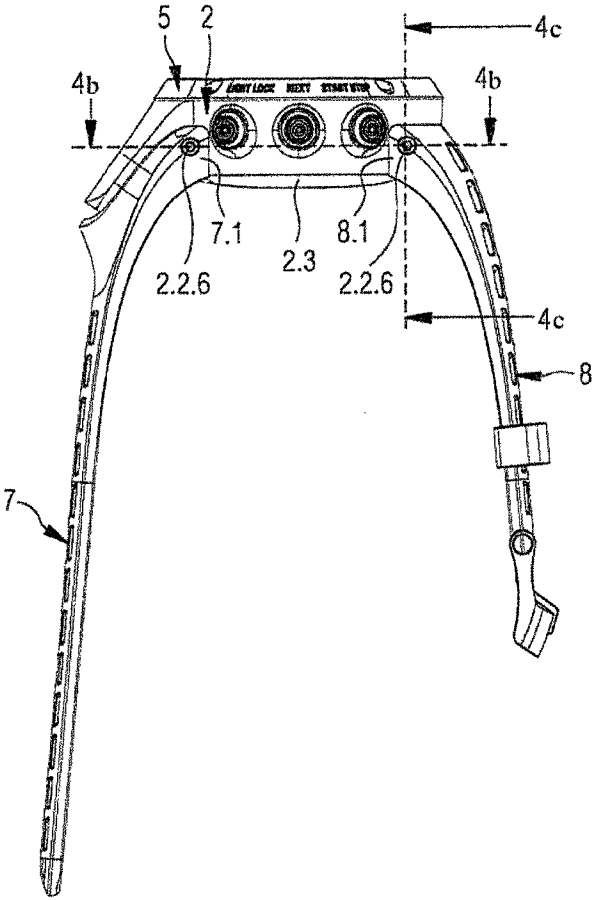
FIG. 4*a* shows a side elevation of the wrist watch device of FIG. 1*a*.

In order to now come to a more detailed description of the structure of the attachment elements 2.2 placed on the main body 2 of the watch case 1, it is to be noted that the attachment elements 2.2 for attaching the at least one watch strap 7, 8 of the wrist watch device to the watch case comprise, as can be seen for example in the perspective view of FIG. 1*b* or the sectional views of FIGS. 4*b* and 4*c*, lateral recesses or indentations 2.2.1, 2.2.2 formed within the external side of the watch case and extending appreciably upwards from of the bottom 2.3 of the watch case. If the corresponding ends 7.1, 8.1 of the watch straps 7, 8 therefore are directly attached to the watch case 1, 2, they at no point do enter into the inner volume 2.1 of the main body 2 of the watch case, which is particularly important for the water tightness of the wrist watch device. Moreover, the attachment elements 2.2 for attaching the at least one watch strap 7, 8 of the wrist watch device to the watch case 1 comprise mounting means 2.2.4, 2.2.5 adapted to be housed inside the lateral indentations 2.2.1, 2.2.2 formed within the external side of the watch case. In particular, the mounting means comprise watch strap holding means 2.2.4 and/or securing means 2.2.5.

As visible for example in FIG. 1*b*, in the preferred embodiment of a watch case according to the present invention, the lateral indentations 2.2.1, 2.2.2 formed within the external side of the watch case comprise, for each watch strap 7, 8, a pair of first lateral indentations 2.2.1 of larger size and usually situated at the outer periphery of the bottom 2.3 of the watch case directed to the watch strap 7, 8 to be mounted. In fact, the pair of first lateral indentations 2.2.1 is adapted to house corresponding ends 7.1, 8.1 of the watch strap 7, 8 to be mounted on the watch case. Furthermore, the lateral indentations 2.2.1, 2.2.2 formed within the external side of the watch case comprise a corresponding pair of second lateral indentations 2.2.2 adapted to house the securing means 2.2.5, each of the second lateral indentations being 2.2.2 situated next to the corresponding first lateral indentation 2.2.1 and separated from this first lateral indentation by a wall 2.2.3 comprising a traversing hole adapted to house the watch strap holding means 2.2.4. In the most simple and robust embodiment, the watch strap holding means 2.2.4 are realized by screws and the securing means 2.2.5 are realized by corresponding nuts. Alternatively, but in less preferred manner, it is also possible to suppress both the second lateral indentations being 2.2.2 and the securing means 2.2.5 by fixing the holding means 2.2.4 directly on the main body 2, e.g. by screwing it into the wall 2.2.3 respectively by similar means. In other preferred embodiments, other forms of fasteners can be used for the strap holding means and/or the securing means, such as, for examples, other forms of screws, nuts, bolts, rivets, clamps, buckles, conventional fasteners, and combinations thereof. In any case, such configuration is an advantageous solution to provide the watch case 1 according to the present invention with non-traversing attachment elements 2.2 in order to obtain a watch case 1, respectively a corresponding main body 2 having at least one portion 2.1.2 of its inner volume 2.1 that extends laterally (or longitudinally) beyond the points of attachment 2.2.6 of the at least one watch strap 7, 8 without being traversed by means required for holding the watch straps 7, 8.

Others attachments means can also be used to fix the wrist strap to the watch case. Examples of others attachments means includes: over molded strap with relief by lateral (or longitudinal) extension, screws/thread inserts in plastic; pressed in studs; snap connection; self threading screws; screws and nuts replaced with shafts and locking rings. More generally, any other known attachment methods from watch industry can be used.

Another important feature of a watch case 1 according to the present invention consists in that, in the most preferred embodiment, the body 2 of the watch case 1 is made of a single piece. The one piece body provides a particularly robust main body 2 of the watch case which, moreover, has the benefit of being aesthetically attractive and having a clean look. Also, the total number of pieces of the watch case 1 may be reduced to a minimum. As visible in FIG. 1*a*, the whole of the watch case 1 comprises in this configuration only the main body 2, the securing ring 3, the gasket 4, and the annular cover 5 with the watch glass 6. To this effect, the body 2 of the watch case may be produced in one piece using molding techniques, preferentially by plastic tooling/molding. Usually, the material used for the body 2 is hard plastic. Others materials, such as metal or ceramic, fiber composite materials, thermoset materials, or combinations thereof are also suitable and other shaping technique such as MIM (metal injection molding), forging or machining could also be used. In this case, it is furthermore possible to conceptually design the watch case 1 such that the inner volume 2.1 of the main body 2 of the watch case 1 for housing internal components of the wrist watch device comprises only one single opening 2.4 oriented towards the opposite side of the bottom 2.3 of the watch case, such as may be seen for example in FIGS. 1*a* and 3*a*. In fact, the only further openings of the main body 2 of the watch case 1 are situated laterally and provide openings for the watch command means which are typically push buttons of known design, this being visible for example in FIG. 1*b* or 4*a*. Moreover, the single opening 2.4 is preferably delimited by an outline lying in a single plane, this enabling a better and cheaper sealing connection. The top surface deliminating the single opening 2.4 lies preferably in the same single plane, and, even more preferably, the delimiting surface of the inner volume 2.1 of the watch case lying in a single plane has a circular circumference, although the circumference may, of course, have any other shape, e.g. oval or rectangular. Such circular delimiting surface is particularly well adapted to be used as sealing boundary, since a sealing gasket 4 of simple, appreciably circular shape and requiring little space may be used to obtain a robust and safe water tightness sealing. In other preferred embodiments, the top surface deliminating and/or the single opening may also have a wedge shape, i.e. do not lies in the same plan as the outline (e.g. being frustroconical).

The present invention also concerns a watch strap 7, 8 being adapted to be used in connection with a watch case 1 such as described here above. As can be seen for example in FIG. 1*a*, 1*b*, 4*a* or 4*c*, such a watch strap 7, 8 has at its extremity to be mounted on the watch case 1 an appreciably U-shaped end portion corresponding in shape and tightly fitting to the external shape of the watch case. The detailed shape of the U-shaped end portion of the watch strap 7, 8 thus may vary to some extent without departing from the present invention. Moreover, the ends 7.1, 8.1 of the U-shaped end portion are adapted for cooperation with above mentioned the indentations 2.2.1, 2.2.2 formed within the watch case 1 as well as with the mounting means 2.2.4, 2.2.5, such as to assure, in the assembled state, attachment of the watch strap 7, 8 to the watch case as well as covering of the indentations 2.2.1, 2.2.2 by the watch strap. The latter allows to improve the aesthetic appearance of the assembled wrist watch device by covering the indentations 2.2.1, 2.2.2 as well as to avoid impurities to enter into these recesses in the watch case. Again, the exact shape of the ends 7.1, 8.1 of the watch straps 7, 8 may vary to some extent depending on the shape of the watch case 1 respectively its indentations 2.2.1, 2.2.2, without departing from the present invention. For example, the strap ends can be generally V shaped, or have other shapes to form two spaced apart end regions. To be complete, it should be noted that it is not obligatorily necessary to provide a wrist watch device according to the present invention on both sides of the watch case with a watch strap of this type, but it would also possible to have mounted on the side of the watch case lacking a lateral prolongation a watch strap rigidly fixed to the watch case or of conventional type, which is, however, not preferred.

Finally, the present invention also relates to any wrist watch device comprising a watch case 1 and/or a watch strap 7, 8 such as described here above. In particular, such a wrist watch device comprises an additional component that is housed in the lateral part 2.1.2 of appreciably longitudinal shape of the inner volume 2.1. The wrist watch device or wrist computer according to the present invention may especially comprise a global positioning system (GPS) unit, i.e. a GPS receiver and antenna which are at least partially housed in the lateral part 2.1.2. Of course, it is possible to house any other components in this lateral part 2.1.2. Such devices, independently of the functionality of the component to be housed in the lateral part 2.1.2, may readily be realized by a person skilled in the art having taken note of the teaching in the present disclosure.

In light of the above description of the present invention and having disclosed above the structure of a watch case, of a corresponding watch strap, as well as of a wrist watch device according to the present invention, its advantages are clear. Due to the fact that a watch case according to the present invention provides an attachment for the watch straps situated both higher in relation to the watch case and closer to each other, it is possible to provide a solution to the above mentioned technical problems with respect to wear comfort of large watch cases, in particular to allow comfortable wear of corresponding wrist watch devices of large size also for people having a smaller wrist circumference. A watch case according to the present invention having, moreover and if desired, a body made of one single piece, is particularly adapted for wrist watch devices and wrist computers requiring excellent water tightness, since the sealing of such a watch case may be realized in simple, space saving, and very safe manner by a single gasket mounted on the circular opening. This configuration is especially advantageous if the main body of the watch case made of a single piece has an inner volume comprising one single upwards opening which is delimited by a circular surface lying in a plane. In fact, next to its excellent properties in terms of water tightness, the resulting watch case is particularly robust, because of being of one piece, and may be designed in an aesthetically attractive manner with a peculiarly clean surface look.

In another embodiment (not shown), the case bottom has a battery receiving cavity with a sealed cover allowing easy access for battery replacement.

While the preferred embodiments of the invention have been illustrated and described, it will be appreciated that various changes can be made therein without departing from the spirit and scope of the invention. For example, one of skill in the art will understand that the invention may also be practiced without many of the details described above. Accordingly, it will be intended to include all such alternatives, modifications and variations set forth within the spirit and scope of the appended claims. Further, some well-known structures or functions may not be shown or described in detail because such structures or functions would be known to one skilled in the art. Unless a term is specifically and overtly defined in this specification, the terminology used in the present specification is intended to be interpreted in its broadest reasonable manner, even though may be used conjunction with the description of certain specific embodiments of the present invention.

What is claimed is:

1. A watch case configured for use with a wristwatch device having a plurality of internal electronic components and first and second watch straps, the watch case having a first longitudinal dimension, the watch case comprising:

a main body defining an inner volume, the main body configured to house the internal electronic components;

a watch glass coupled to the main body, the watch glass defining a watch glass plane, the internal electronic components being positioned beneath the watch glass plane with none of the internal electronic components extending above the watch glass plane; and a plurality of strap attachment elements connected to the main body, the attachment elements including a first set of strap attachment points longitudinally spaced apart from a second set of strap attachment points, the first and second sets of strap attachment points configured for coupling the first and second watch straps to the main body, respectively, the first and second sets of strap attachment points defining first and second transverse lines, respectively, the first and second transverse lines defining a first plane, at least a portion of the inner volume of the main body and at least a portion of one of the internal electronic components longitudinally extending beyond at least one of the first and second transverse lines; and at least a portion of one of the internal electronic components extending below the first plane.

2. The watch case of claim 1, wherein the main body includes a bottom that generally defines a bottom plane, and wherein the first plane is parallel with the bottom plane.

3. The watch case of claim 2, wherein each of the first and second transverse lines is positioned above the bottom plane.

4. The watch case of claim 1, wherein the first and second transverse lines are longitudinally spaced apart by a second longitudinal dimension, and wherein the second longitudinal dimension is sized to be within the range of 50 to 90 percent of the first longitudinal dimension.

5. The watch case of claim 4, wherein the second longitudinal dimension is sized to within the range of 65 to 85 percent of the first longitudinal dimension.

6. The watch case of claim 1, wherein the main body has an outer surface, wherein the main body defines a first plurality of indentations inwardly extending from the outer surface, and wherein the first plurality of indentations correspond to the first and second sets of attachment points of the plurality of attachment elements.

7. The watch case of claim 6, wherein the main body includes a bottom that generally defines a bottom plane, and wherein at least two of the first indentations are positioned above the bottom plane.

8. The watch case of claim 6, wherein at least one of the first indentations is sufficiently sized to substantially fully receive one of the strap attachment elements.

9. The watch case of claim 6, wherein each of the first indentations is sufficiently sized to receive a separate one of the strap attachment elements.

10. The watch case of claim 6, wherein the first watch strap includes a first watch strap end, wherein the main body defines a plurality of second indentations, and wherein at least one of the second indentations is sized to receive the first watch strap end.

11. The watch case of claim 10, wherein the first watch strap end includes a pair of laterally spaced apart end regions, and wherein at least two of the second indentations are sized to receive the pair of end regions.

12. The watch case of claim 1, wherein the strap attachment elements are selected from the group consisting of screws, nuts, bolts, rivets and combinations thereof.

13. The watch case of claim 1, wherein the main body is one single integral piece excluding the watch glass and any other separate cap or cover element.

14. The watch case of claim 2, wherein the main body defines a single opening positioned opposite the bottom, and wherein the single opening is delimited by a surface lying in a single plane.

15. The watch case of claim 14, wherein the delimiting surface of the inner of the main body lies in a single sealing plane having a circular circumference.

16. The watch case of claim 1, wherein the first watch strap includes a first watch strap end, and wherein the first watch strap end is generally U-shaped to form two laterally spaced apart end regions corresponding to the first set of strap attachment points.

17. The watch case of claim 1 wherein the plurality of internal components are selected from the group consisting of a global positioning system unit, a pressure sensor, an altimeter, a barometer, a cardiac frequency sensor, a radio receiver and combinations thereof.

18. The watch case of claim 1, wherein no portion of the main body extends above the watch glass plane.

* * * * *